US005911234A

United States Patent [19]

Hirst

[11] Patent Number: 5,911,234

[45] Date of Patent: Jun. 15, 1999

[54] SLING ASSEMBLY FOR A PAIR OF CRUTCHES

[76] Inventor: Eric Hirst, 4240 Phinney Ave. N., Seattle, Wash. 98103-7122

[21] Appl. No.: 08/950,685

[22] Filed: Oct. 15, 1997

[51] Int. Cl.[6] ..... A61H 3/02

[52] U.S. Cl. ..... 135/68; 135/65; 244/151 R; 119/770; 182/3

[58] Field of Search ..... 135/65–68; 182/3; 272/275; 244/151 R, 151 B; 119/857, 797, 770; 114/39.1; 297/275

[56] References Cited

U.S. PATENT DOCUMENTS

| | | | |
|---|---|---|---|
| 2,657,735 | 11/1953 | Hughes | 297/275 X |
| 2,852,066 | 9/1958 | Hawkins | 182/3 |
| 3,701,395 | 10/1972 | Theobald | 182/3 |
| 3,778,052 | 12/1973 | Andow et al. | 135/65 X |
| 4,245,659 | 1/1981 | Shofner | 135/68 |
| 4,508,045 | 4/1985 | Spanier | 114/39 X |
| 4,941,497 | 7/1990 | Prather et al. | 135/67 |
| 5,145,027 | 9/1992 | Petzl et al. | 183/3 |
| 5,313,971 | 5/1994 | Upshaw | 135/68 |
| 5,348,035 | 9/1994 | Porter | 135/66 |

OTHER PUBLICATIONS

Sammons–Preston Catalog, "Crutch Sling" Item 190 6815.

*Primary Examiner*—Carl D. Friedman
*Assistant Examiner*—Winnie S. Yip
*Attorney, Agent, or Firm*—Davis and Bujold

[57] ABSTRACT

A crutch sling assembly for use with a pair of crutches. The crutch sling assembly comprising a sling seat for engaging at least one of a buttock and crotch area of a sling user and supporting a portion of the weight of a user of said crutch sling assembly. Intermediate portions of the first and second elongate straps are connected to the sling seat. The first and second elongate straps each have an attachment mechanism for connecting each one of the first elongate strap and the second elongate strap to one of a pair of crutches.

14 Claims, 5 Drawing Sheets

SLING ASSEMBLY FOR A PAIR OF CRUTCHES

FIELD OF THE INVENTION

The present invention relates generally to a sling support system for use with a pair of crutches and, more particularly, to a crutch sling arrangement which serves to support a significant portion of the body weight of a user thereby lessening the load which has to be supported by the user's hands, arms, legs and/or underarms and increasing the comfort of the user.

BACKGROUND OF THE INVENTION

None of the known harness assemblies, for use with crutches, are designed to be worn comfortably by the user over a prolonged period of time. For example, U.S. Pat. No. 5,348,035, issued to Porter on Sep. 20, 1994, relates to a complex crutch harness assembly which has a pair of strap members which directly support each leg. The shortcoming associated with this arrangement is that the straps are uncomfortable to wear and generally have a tendency to cut off the blood circulation to the legs thereby rendering the harness assembly relatively uncomfortable to wear.

SUMMARY OF THE INVENTION

It is an object of the invention to provide a sling assembly which has a comfortable seat that is better able to support a significant portion of the wearer's weight, without providing discomfort to the user, and has various adjustment points to allow proper fitting of the sling arrangement to virtually any user of the same.

A further object of the invention is to provide a sling arrangement which can, if desired, be worn under regular clothing of the user so that it is not readily visible or detectable while still being comfortable to wear.

Still another object of the invention is to provide the sling arrangement with a seat area having an hourglass shape so that the sling assembly has a curvature which comfortably mates with the crutch and buttocks area of a user.

Yet another object of the invention is to provide a sling assembly which is easy to put on and take off while still being relatively comfortable to wear.

A further object of the invention is to provide a sling assembly which is easily washable, dries quickly and can be provided with an optional padding and/or an anti-odor substance.

Still another object of the invention is to provide a sling assembly which is quickly and easily releasable from, and re-attachable to, a given pair of crutches or some other walking aid apparatus, by the user.

Another object of the invention is to provide a sling assembly which is relatively simple and inexpensive to manufacture while still allowing a user to walk more quickly and easily with less effort.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
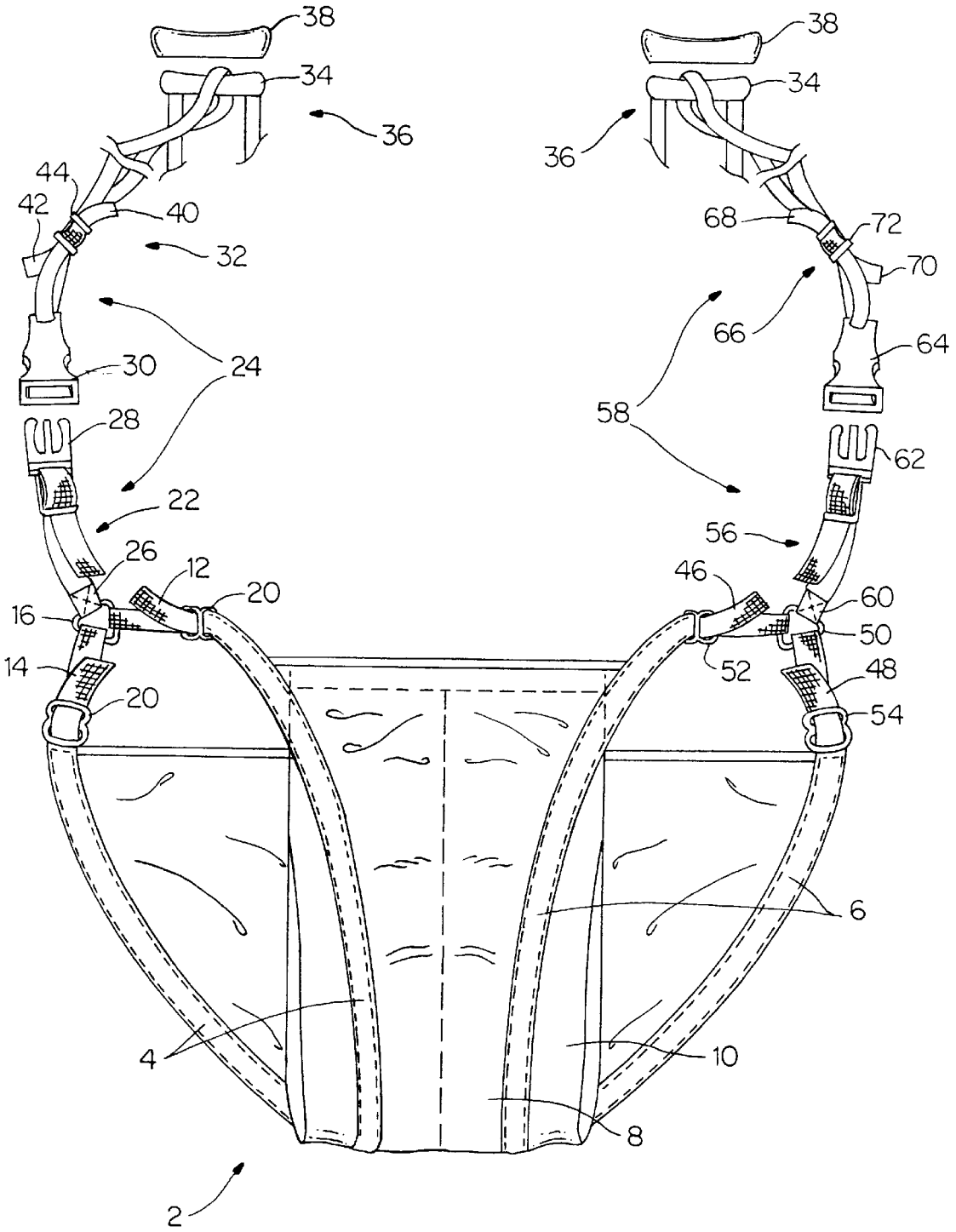
FIG. 1 is a diagrammatic perspective view of the sling assembly according to the present invention.

Turning now to FIGS. 1 to 4, a detailed description concerning the sling assembly, according to the present invention, will now be provided. As can be seen in those Figures, a sling assembly 2 comprises a first elongate member or strap 4 and a second elongate member or strap 6. Each one of the elongate straps 4, 6 are interconnected to one another, along an intermediate length of each elongate strap, by being stitched to a fabric material or support 8 along a pair of opposed longitudinal side edge surfaces of the fabric support 8. The fabric support 8 forms, along with the intermediate portions of the first and second elongate straps 4, 6, a seat for supporting the buttock and crotch area of a user. A further detailed description concerning the purpose of the seat will be provided hereinafter.

The first and second elongate straps 4, 6, can be made of a cotton, nylon, polyester, a poly-fiber material, or other suitable material able to support the weight of a user. The fabric support 8 located between the two elongate straps 4, 6, can be made of any material also able to support the weight of a user, for example, a cloth, a netting, mesh material, etc. The fabric support 8 may contain longitudinally or transverse extending sections which are more elastic relative to other sections such that the resulting support structure better fits or conforms to the anatomical contours of a particular user and/or reduces shifting while the sling is under load. If desired, the fabric support 8, could also have additional structural support elements imbedded or woven in the fabric support 8 to provide additional support thereto.

A top surface of the support 8 can be provided with a padding layer 10, made of cotton, pile, fleece, or any other desired absorbent or soft and fluffy material, to provide a desired padding and/or absorbance, depending upon the application. The padding layer 10 can be either sewn, glued or otherwise affixed or attached, in a conventional manner, to a top surface 11 of the fabric support 8. If desired, the padding layer 10 can be releasably attached to a top surface 11 of the fabric support 8 by mating male and female touch fasteners, e.g. VELCRO™ for example, or some other conventional releasable fastener to facilitate replacement and/or separate washing of the padding layer 10, as necessary.

Figure 2:
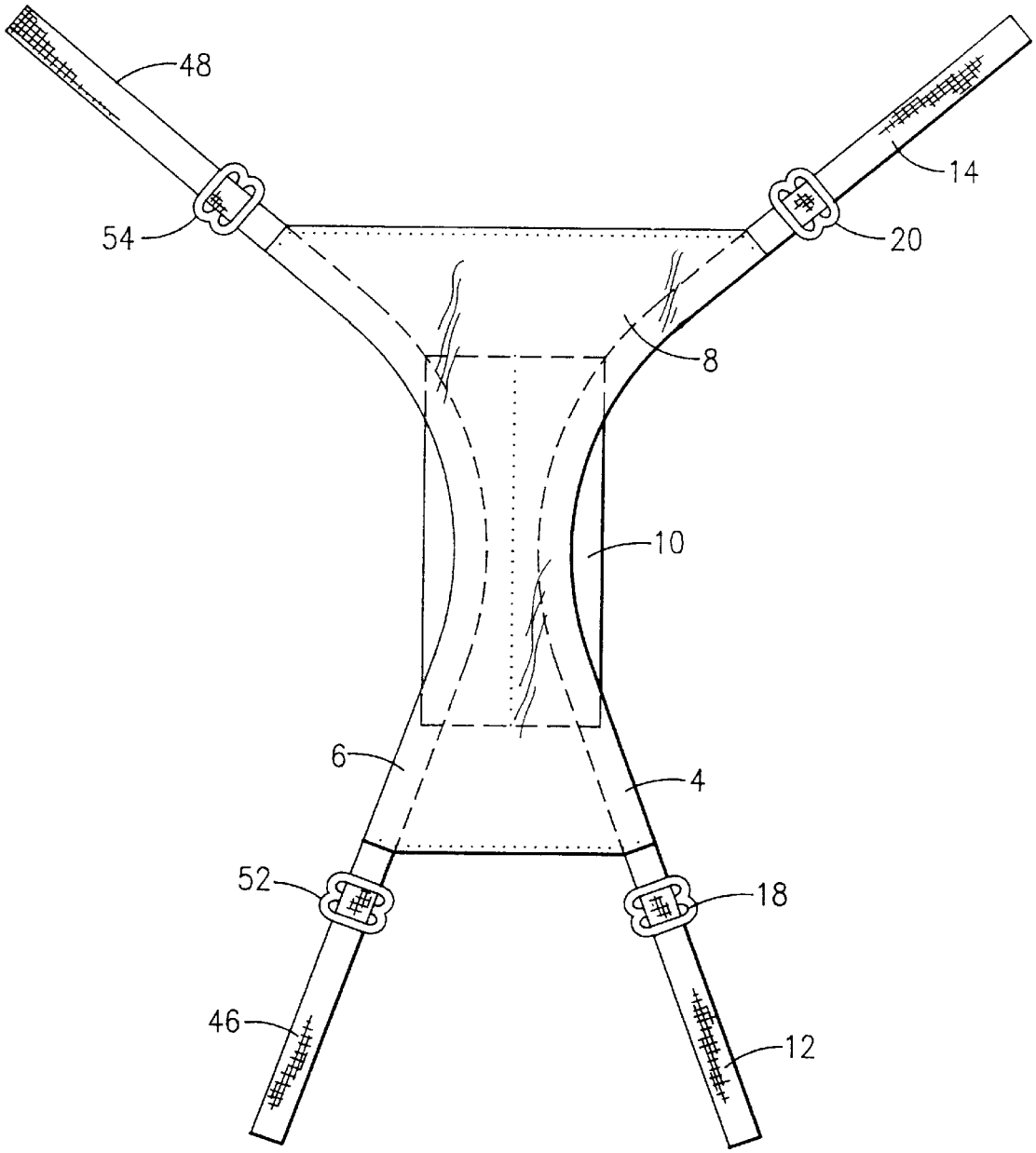
FIG. 2 is a diagrammatic bottom plan view of the sling assembly of FIG. 1.
Figure 3:
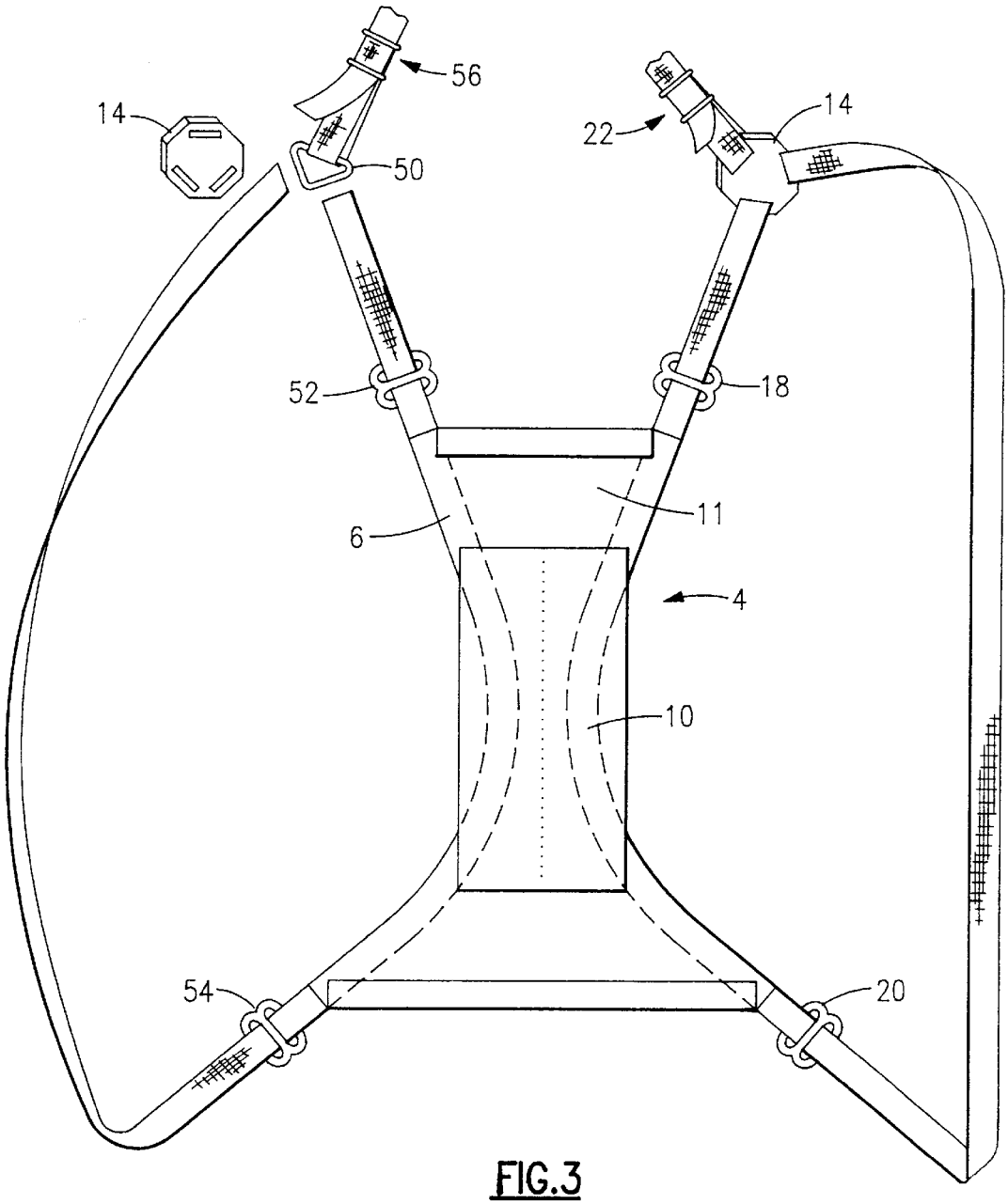
FIG. 3 is a diagrammatic top plan view of the sling assembly of FIG. 1.
Figure 4:
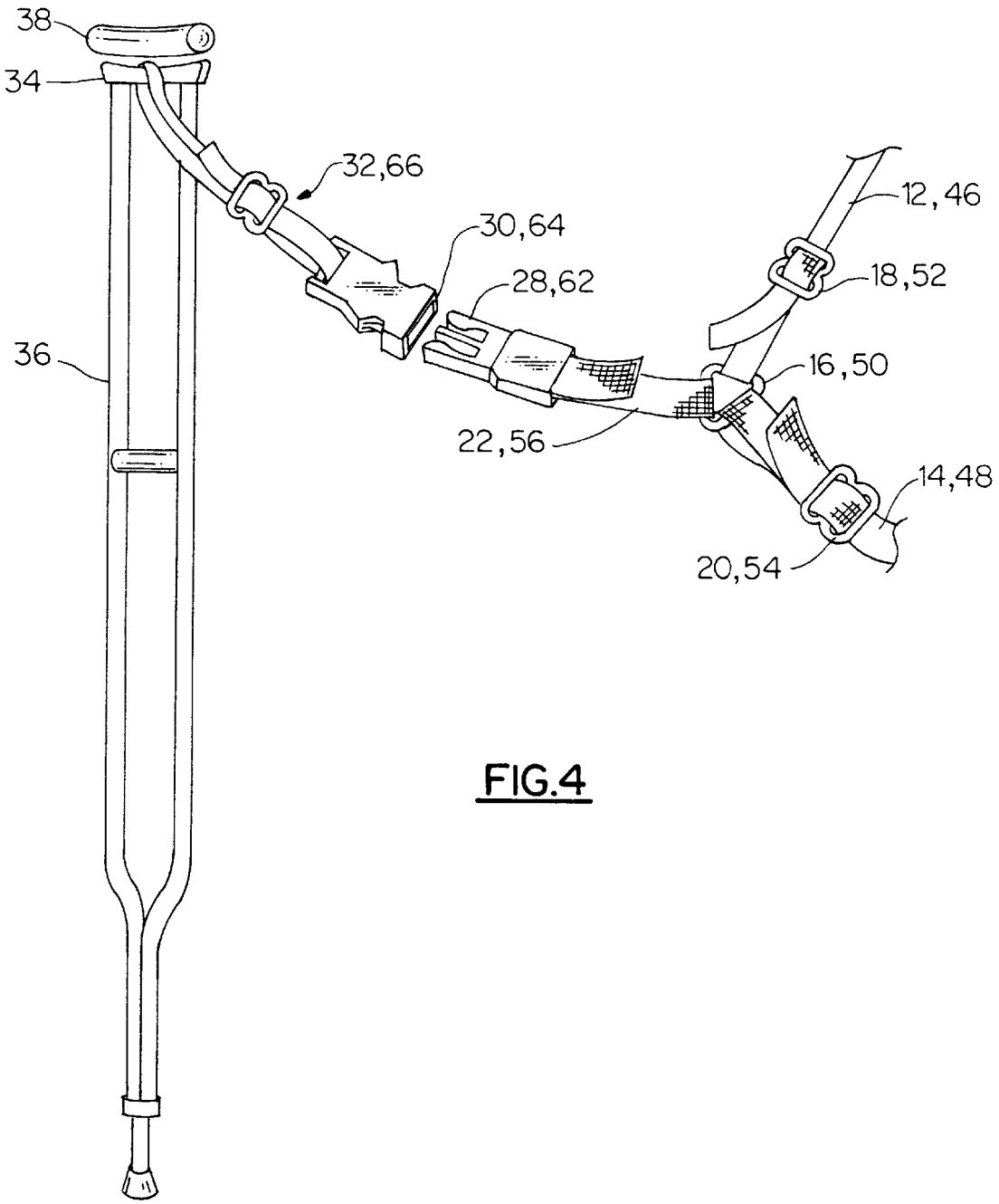
FIG. 4 is a diagrammatic view showing coupling of a second portion of the crutch strap to a conventional crutch.
Figure 5:
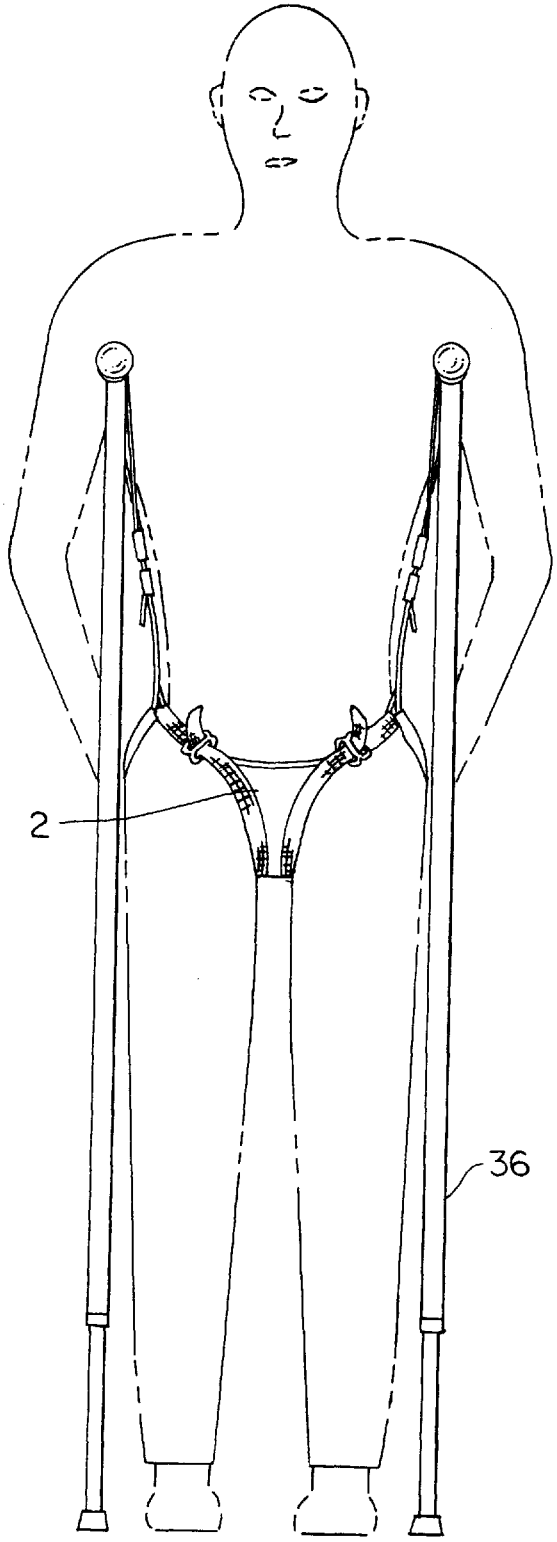
FIG. 5 is a diagrammatic perspective view showing use of the sling assembly with a pair of crutches.
Figure 6:
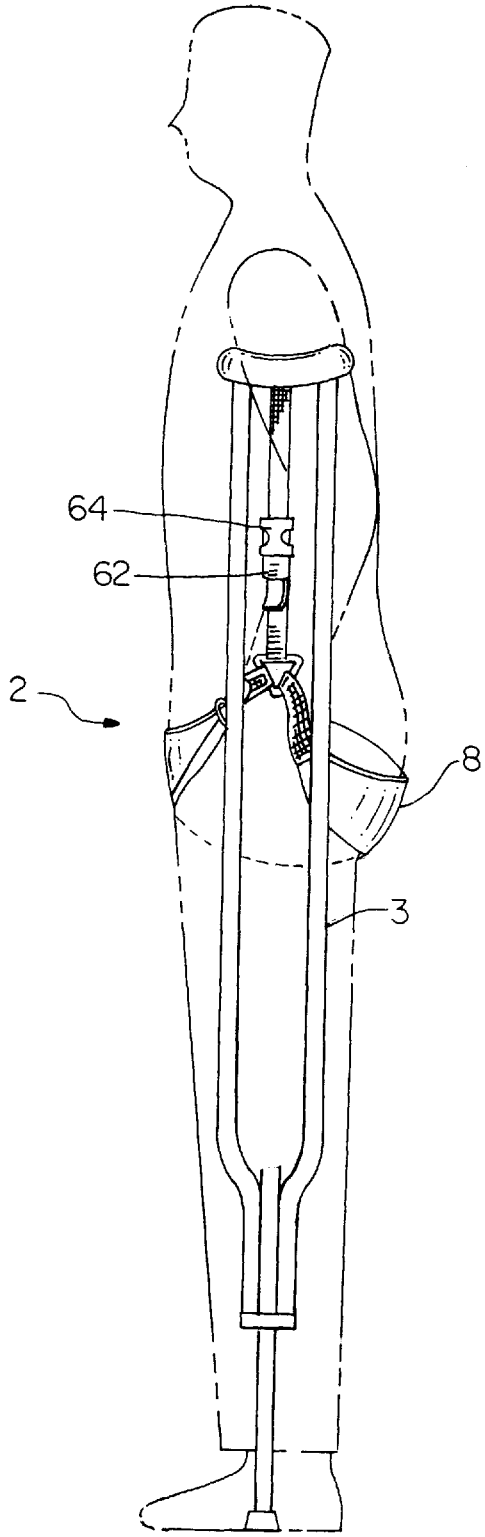
FIG. 6 is a diagrammatic side elevational view of FIG. 5.

As depicted in the Figures, the fabric support 8, when lying flat on a flat surface, has a generally concave hourglass shape or configuration, i.e. each of the pair of opposed longitudinal side edge surfaces of the fabric support 8 is curved along its length. Accordingly, when a load is placed on the elongate straps 4, 6, both vertical and lateral tension is provided to the fabric support 8, via the elongate straps 4, 6, such that the fabric support 8 will not bunch up but rather is held in a relatively taut arrangement or configuration to more evenly and effectively support the weight of the user. The front facing end portion of the fabric support 8 has a shorter length than the lenght of the rear facing end portion of the fabric support 8, as can be seen in FIGS. 2 and 3.

It is to be appreciated that, while still generally maintaining the concave hourglass shape, the fabric support 8 can be cut, shaped or provided with any number of desired areas, sections, pockets, depressions, etc., to better fit the anatomical contours of the user. Such modification of the sling assembly readily facilitates the use of the present invention for maternity or obesity applications, for example.

The first elongate strap 4 comprises an elongate member which has opposed first and second ends 12, 14. The first end 12 passes through a first triangular-shaped coupling member 16 (FIG. 1) and is folded back over itself and is connected to a first conventional strap fastener 18 which is supported along the first end 12 of the first elongate strap 4. The first conventional strap fastener 18 allows secure adjustment of the spacing of the triangular-shaped coupling member 16 from an adjacent end portion of the fabric support 8 so that the sling assembly can be adjusted to fit a desired user. A further detailed discussion concerning the same will be provided hereinafter.

The second end 14 of the first elongate strap 4 is also coupled to the same triangular-shaped coupling member 16. That is, the second end 14 passes through the triangular-shaped coupling member 16 and is folded back over onto itself and is connected to a second conventional strap fastener 20 which is supported along the second end 14 of the first elongate strap 4. The second conventional strap fastener 20 allows adjustment of the spacing of the triangular-shaped coupling member 16 from an opposed adjacent end portion of the fabric support 8 so that the sling assembly can be further adjusted to fit a desired user.

A first section 22 of a crutch strap 24 is also coupled to the same triangular-shaped coupling member 16. The first section 22 of the crutch strap 24, after passing through the triangular-shaped coupling member 16, is folded over onto itself and is stitched, at 26, to an adjacent portion of the first section 22 of the crutch strap 24 so that end is permanently fastened to the triangular-shaped coupling member 16. Alternatively, the first section 22 of the crutch strap 24 could be removably and/or adjustably fastened to the triangular shaped coupling member 16, if desired, by a similar fastener to that of strap fasteners 18 or 20, or some other suitable fastening mechanism. The opposite end of the first section 22 of the crutch strap 24 is adjustably connected to a male fastener 28 which can be releasably coupled to a mating female fastener 30. It is to be appreciated that the male fastener 28 is designed such that the distance or spacing of the male fastener 28 from the triangular-shaped coupling member 16 can be adjusted, as desired, to facilitate adjustment of the crutch sling assembly to fit any desired user.

The female fastener 30, in turn, is connected to and supported by a second section 32 of the crutch strap 24. A portion of the second section 32 of the crutch strap 24 passes around a cross member 34 located at the top the crutch 36. The cross member 34 is typically designed, during use, to engage the armpit of a user. The second section 32 of the crutch strap 24 is located between the cross member 34 and a rubber pad 38 which encases a major part of the cross member 34 to provide padding for the armpit during use of the crutch 36. The rubber pad 38 and the crutch cross member 34 combine to sandwich that portion of the second section 32 therebetween to prevent any undesired slipping or sliding motion of the second section 32 relation to the cross member 34. Alternatively, the second section 32 of the crutch strap 24 could be permanently secured in place on the cross member 34, or some other portion or area of the crutch 36, via a suitable fastener which would prevent the second section 32 from slipping or sliding, while not being an uncomfortable imposition on the user. Lastly, the two opposed free ends of 40, 42 of the second section 32 are coupled to one another by a third conventional fastener 44 which allows adjustment of the spacing of the female fastener 30 from the cross member 34 but still provides secure attachment of the two opposed ends 40, 42 to one another to prevent slippage therebetween. The third conventional fastener 44 facilitates adjustment of the crutch sling assembly 2 relative to the cross member 34, as desired.

The second elongate strap 6 also comprises an elongate member which has opposed first and second ends 46, 48. The first end 46 passes through a second triangular-shaped coupling member 50 and is folded back over itself and is connected to a fourth conventional strap fastener 52 which is supported along the first end 46 of the second elongate strap 6. The fourth conventional strap fastener 52 allows adjustment of the spacing of the second triangular-shaped coupling member 50 from an adjacent end portion of the fabric support 8 so that the sling assembly 2 can be adjusted to fit a desired user. A further detailed discussion concerning the same will be provided hereinafter.

The second end 48 of the second elongate strap 6 is also coupled to the same second triangular-shaped coupling member 50. That is, the second end 48 passes through the triangular-shaped coupling member 50 and is folded back over onto itself and is connected to a fifth conventional strap fastener 54 which is supported along the second end 48 of the second elongate strap 6. The fifth conventional strap fastener 54 allows adjustment of the spacing of the triangular-shaped coupling member 50 from a second opposed adjacent end portion of the fabric support 8 so that the sling assembly 2 can be further adjusted to fit a desired user.

A first section 56 of a second crutch strap 58 is also coupled to the second triangular-shaped coupling member 50. The first section 56 of the second crutch strap 58, after passing through the triangular-shaped coupling member 50, is folded over onto itself and is stitched, at 60, to an adjacent portion of the first section 56 of the crutch strap 58 so that end is permanently fastened to the triangular-shaped coupling member 50. Alternatively, the first section 56 of the crutch strap 58 could be removably and/or adjustably fastened to the triangular shaped coupling member 50, if desired, by a similar fastener to that of strap fasteners 52 or 54, or some other suitable fastening means. The opposite end of the first section 56 of the crutch strap 58 is adjustably connected to a second male fastener 62 which can be releasably coupled to a mating female fastener 64. It is to be appreciated that the male fastener 62 is designed such that the distance or spacing of the male fastener 62 from the second triangular-shaped coupling member 50 can be adjusted, as desired, to facilitate adjustment of the crutch sling assembly 2 to fit any desired user.

The female fastener 64, in turn, is connected to and supported by a second section 66 of the crutch strap 58. A portion of the second section 66 of the crutch strap 58 passes around the other cross member 34 located at the top of the other crutch 36. This cross member 34 is also typically designed to engage with the armpit of a user. The second section 66 of the crutch strap 58 is located between the cross member 34 and a rubber pad 38 which encases the cross member 34 to provide padding for the armpit during use of the crutch 36. The rubber pad 38 and the crutch cross member 34 combine to sandwich that portion of the second section 32 therebetween to prevent any undesired slipping or sliding motion of the second section 66 relative to the cross member 34. Alternatively, the second section 66 of the crutch strap 58 could be permanently secured in place on the cross member 34, or any other portion or area of the crutch 36, via a suitable fastening mechanism which would prevent the second section 66 from slipping, while not being an uncomfortable imposition on the user. Lastly, the two opposed ends of 68, 70 of the second section 66 are coupled to one another by a sixth conventional fastener 72 which allows adjustment of the spacing of the female fastener 62 from the cross member 34 without allowing undesired slippage therebetween. The sixth conventional fastener 72 facilitates adjustment of the crutch sling assembly 2 from the cross member 34, as desired.

It should be appreciated that, as shown in FIG. 3, a fabric buffer or cushion element 74 can be attached adjacent each of the triangular-shaped coupling members 16, 50, between the coupling members 16, 50 and the user, to prevent the coupling members 16, 50 from chaffing or digging into the hip or side of the user. In the present embodiment, this fabric buffer or cushion element 74 is basically octagonal in shape and has three spaced apart slots 76, 78, 80 arranged in a triangle formation. The fabric buffer or cushion element 74 is placed over the triangular-shaped coupling member 16, 50 and each of the straps 12, 14, 22, or 46, 48, 56 is fed through one of the slots 76, 78, 80 to hold the fabric buffer or cushion 74 centered in place over the triangular-shaped coupling member 16, 50. The fabric buffer or cushion element 74 can be made of any type of padded or fluffy material such that it will protect the user from the hard structure of the coupling member 16, 50. It can also be fastened by any conventional means able to withstand the potential rubbing forces to be placed on the buffer or cushion element 74 during use.

It is to be appreciated that the crutch sling assembly 2, of the present invention, can be worn under the clothing of an individual, e.g. between conventional underwear and the exterior clothing of the user whereby only a portion of the first sections 22 and 36 of the crutch straps 24 and 58 will typically extend out of the pants, skirt, dress, or other clothing of a user, for example. Accordingly, only the male fasteners 28 and 62 and a small length of the first sections 22 and 56 of the crutch strap 24 and 58 will be visible when the crutch sling assembly 2 is worn in this fashion as an undergarment. Alternatively, the crutch sling assembly 2 can be merely worn on the exterior over the clothing of a user so that it is visible and easily taken off when necessary or desired.

It should also be noted that the entire sling assembly 2 can be attached to a crutch or set of crutches in various manners. For example, there could be a number of straps used to secure the sling assembly 2 to a crutch or some other walking apparatus, e.g. a four-leg walker. The additional straps may better serve to distribute the load to be supported more evenly and increase the amount of weight which is supportable by the sling assembly 2. Further, the straps could be permanently attached to any upper portion of a crutch structure, so long as the straps are able to support the required load.

Occasionally, during use of the present invention in conjunction with aluminum/plastic crutches, a squeak may be generated at the intersection of the armpit cross bar and the metal vertical extending side tubes. Such squeak can be avoided or lessened by providing alternate connection means and locations, as briefly discussed above, as well as making modifications to the crutch structure.

The elongate straps 4, 6, could comprise two separate shorter length sections and one end of each shorter length section is attached to the fabric support 8 only adjacent the wider end locations and not along the narrower central area. That is, the straps 4, 6 could simply be attached to the fabric support 8 at the outer edges and/or ends and not along the entire length of the opposed longitudinal side edge surfaces of the fabric support 8. According to such an embodiment, the sling portion would be constructed to support the applied weight, rather than relying on the elongate straps to support some of the weight in the crotch area.

Use of the present invention will now be described. Typically, a user will attach the second section 32 of the crutch strap 24 to a first one of the two crutches 36, e.g. between the cross member 34 and the rubber pad 38 attached thereto, or to some other member of the walking aid apparatus. Thereafter, the user will attach the second section 66 of the second crutch strap 58 to the other crutch 36 in a similar manner.

Next, the user then wears the crutch sling assembly 2 in a similar manner to putting on a pair of pants or underwear, such that the padding layer 10 will abut against the crotch and/or buttocks area of the user. Thereafter, the fasteners 18, 20, 44, 52, 54 and/or 72 are adjusted, as necessary, so that the sling 2 is comfortably worn and/or fitted to the user. When the user desires to use the pair of crutches 36, for example, for walking the user will interconnect the first male fastener 28 with the mating first female fastener 30, previously supported by a first one of the crutches 36, and will similarly connect the second male fastener 62 to the mating second female fastener 64, previously supported by the other crutch 36. This is typically done once the user is in a standing position prior to using the pair of crutches 36, 36 in a conventional manner.

It is to be appreciated that the design of the crutch sling assembly 2 is such that the crutch straps 24 and 58 should be under some tension, when using the pair of crutches 36, 36 in a conventional manner, so that the sling assembly 2 will support, during use, a desired amount of the weight of the user. Therefore, once the user has connected the two male fasteners 28, 62 to the respective mating female fasteners 30, 64, the user will shorten or lengthen the crutch straps 24 and 58, via fasteners 44 and/or 72, as necessary to attain a desired tension level on the crutch straps 24 and 58. Depending upon the degree of tension experienced by the crutch straps 24 and 58 this will, in turn, affect the amount of weight of the user being supported by the crutch sling assembly 2.

The fastener and coupler devices 16, 18, 20, 28, 30, 44, 50, 52, 54, 62, 64, and 72 can be made of any suitable material, for example, a plastic, a composite, or a metal, which is able to withstand the forces experienced by the devices in normal usage of the sling assembly 2.

The coupling members 16 and 50 can also be an alternate shape such as a circle, square, rectangle, or some other multi-sided shape as long as the straps are suitably connected thereto.

Alternate fastening devices may also be utilized, such as clamps, clasps, hooks, knots, pins and receivers, VELCRO™, etc., so long as the various straps are adequately supported.

Each crutch is conventional and typically comprises a central leg which is adjustably supported by conventional removable fasteners supported between a pair of elongate longitudinally extending vertical side members. Each one of the two longitudinally extending side members are connected to one another by a armpit cross member and a hand cross member. The armpit cross member is preferably fixedly secured at one end of the longitudinally extending side members while the second hand cross member is adjustably secured to an intermediate section of the longitudinally extending side members so that the position of the hand cross member can be varied, as desired.

Although a conventional crutch is contemplated for use with the present invention, it is to be appreciated that alternate crutch structures or other walking aid apparatuses, including but not limited to conventional four-leg walkers, may be utilized in combination with the sling assembly. Further, the elongate straps and the sling assembly of the present invention can be modified to work in conjunction with virtually any desired walking aid apparatus. As such crutch and walker aid apparatuses are well known in the art, a further detailed description concerning the same is not provided.

Since certain changes may be made in the above described sling apparatus, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A crutch sling assembly for use with a walking aid apparatus, said crutch sling assembly comprising:

a sling seat for engaging at least one of a buttock and crotch area of a user and supporting a portion of a weight of the user of said sling assembly;

a first elongate strap, having opposed ends, and a second elongate strap, having opposed ends, each of the first and second elongated straps being connected to said sling seat for providing support thereto, during use;

the opposed ends of said first elongate strap being connected to a first common coupling member which supports a first attachment mechanism for attaching a first portion of said sling assembly to a walking aid apparatus; and the opposed ends of said second elongate strap being connected to a second common coupling member which supports a second attachment mechanism for attaching a second portion of said sling assembly to the walking aid apparatus.

2. The sling assembly according to claim 1, wherein said sling seat has a substantially hourglass shape with an intermediate portion of each of said first elongate strap and said second elongate strap being attached along each opposed longitudinal edge of said sling seat.

3. The sling assembly according to claim 2, wherein said opposed longitudinal edges of said sling seat each have a concave shape.

4. A crutch sling assembly for use with a walking aid apparatus, said crutch sling assembly comprising:

a sling seat for engaging at least one of a buttock and crotch area of a user and supporting a portion of a weight of the user of said sling assembly;

a first elongate strap, having opposed ends, and a second elongate strap, having opposed ends, each of the first and second elongated straps being connected to said sling seat for providing support thereto, during use; and a pair of attachment mechanisms each releasably connecting to the opposed ends of the respective first and second elongated straps for connecting each of said first and second elongate straps to a walking aid apparatus to support said sling assembly during use;

wherein said sling seat includes a padded layer which is one of removably attached and permanently secured to a top surface of said sling seat.

5. The sling assembly according to claim 1, wherein each opposed end of said first elongate strap includes a fastening member for adjusting the relative position of said first coupling member along said first elongate strap; and each opposed end of said second elongate strap includes a fastening member for adjusting the relative position of said second coupling member along said second elongate strap.

6. The sling assembly according to claim 1, wherein said coupling member is a triangular-shaped member.

7. The sling assembly according to claim 6, wherein a padding member is supported adjacent said coupling member to prevent said coupling member from directly rubbing against a body of the user using said sling assembly.

8. The sling assembly according to claim 1, wherein said attachment mechanisms comprise:

a first crutch strap which comprises a first section which is secured to said first coupling member and a second section which is adapted to be secured to the walking aid apparatus and said first section carries one of a male and a female connector and said second section carries the other male and female connector; and a second crutch strap which comprises a first section which is secured to adapted to be said second coupling member and a second section which is adapted to be secured to the walking aid apparatus and said first section carries one of said male and female connector and said second section carries the other said male and female connector.

9. The sling assembly according to claim 1, wherein said sling seat is manufactured from one of a fabric material, a mesh material, and a netting material.

10. The sling assembly according to claim 1, wherein said attachment mechanisms for connecting said first elongate strap and said second elongate strap to said walking aid apparatus is releasably attachable to, said walking aid apparatus by said sling user.

11. The sling assembly according to claim 1, wherein a length of said first and second elongate straps is adjustable, via at least one fastener supported by said first and second elongate strap, by said user to adjust a desired amount to be supported during use of said sling assembly.

12. The sling assembly according to claim 1, in combination with a pair of crutches utilized as said walking aid apparatus, each of said crutches being elongate and having an armpit cross member for engagement with an armpit of a user and a hand cross member for engagement by the hands of a user and said armpit cross member supports a portion of said attachment mechanism.

13. A sling assembly for use with a pair of crutches, said sling assembly comprising:

a sling seat for engaging at least one of a buttock and crotch area of a user and supporting a portion of weight of the user of said sling assembly;

a first elongate strap and a second elongate strap each being connected to said sling seat for providing support thereto, during use;

a pair of attachment mechanisms for connecting each of said first and second elongate straps to a walking aid apparatus to support said sling assembly during use opposed ends of said first elongate strap are coupled to a common first coupling member which supports one of said attachment mechanism for attaching said sling assembly to a crutch; and opposed ends of said second elongate strap are connected to a common second coupling member which supports a second one of attachment mechanisms for attaching said sling assembly to a crutch.

14. A method of using a sling assembly with a first and a second crutch, said method comprising the steps of:

providing a sling seat, with first and second opposed longitudinal edges, for engaging at least one of a buttock and crotch area of a user and supporting a portion of a weight of the user of said sling assembly during use;

connecting a first elongate strap along the first longitudinal edge and a second elongate strap along the second longitudinal edge of said sling seat for providing support thereto;

connecting a first end of a first attachment mechanism to opposed ends of said first elongate strap and connecting a first end of a second attachment mechanism to opposed ends of said second elongate strap; and connecting a second end of said first attachment mechanism to said first crutch and connecting a second end of said second attachment mechanism to said second crutch; and supporting at least a portion of the weight of a user with said sling assembly during use thereof.

* * * * *